US010312066B1

(12) United States Patent
Reilly et al.

(10) Patent No.: US 10,312,066 B1
(45) Date of Patent: Jun. 4, 2019

(54) GENERATION OF DIGITAL WAVEFORMS WITH HIGH RESOLUTION DUTY CYCLE

(71) Applicant: Washington State University, Pullman, WA (US)

(72) Inventors: Peter T. A. Reilly, Pullman, WA (US); Brian Herbert Clowers, Pullman, WA (US); Zachary Philip Gotlib, Pullman, WA (US); Nathan Michael Hoffman, Pullman, WA (US)

(73) Assignee: Washington State University, Pullman, WA (US)

( * ) Notice: Subject to any disclaimer, the term of this patent is extended or adjusted under 35 U.S.C. 154(b) by 0 days.

(21) Appl. No.: 15/957,812

(22) Filed: Apr. 19, 2018

(51) Int. Cl.
*H01J 49/00* (2006.01)
*H01J 49/02* (2006.01)
*H01J 49/34* (2006.01)

(52) U.S. Cl.
CPC ..... *H01J 49/0031* (2013.01); *H01J 49/022* (2013.01); *H01J 49/34* (2013.01)

(58) Field of Classification Search
CPC ..... H01J 49/0027; H01J 49/0031; H01J 49/0036; H01J 49/022; H01J 49/025; H01J 49/34; G01N 27/622
See application file for complete search history.

(56) References Cited

U.S. PATENT DOCUMENTS

2004/0079875 A1* 4/2004 Ding ..... H01J 49/424 250/282
2013/0313421 A1* 11/2013 Taniguchi ..... H01J 49/063 250/281

* cited by examiner

*Primary Examiner* — David E Smith
(74) *Attorney, Agent, or Firm* — Lee & Hayes, P.C.

(57) ABSTRACT

Systems and methods for generating digital waveforms with high-resolution duty cycles are disclosed. A smoothed sinusoidal waveform set to a voltage other than ground may be generated and/or received. A rectangular waveform may be generated based on the sinusoidal waveform using a comparator. The rectangular waveform may be utilized to adjust the duty cycle of a current applied to a mass analyzer to improve duty-cycle resolution of a mass analyzer of a mass spectrometer.

20 Claims, 6 Drawing Sheets

GENERATION OF DIGITAL WAVEFORMS WITH HIGH RESOLUTION DUTY CYCLE

GOVERNMENT LICENSE RIGHTS

This invention was made with government support under grant no. DBI1352780 awarded by National Science Foundation. The government has certain rights in the invention.

CROSS REFERENCE TO RELATED APPLICATIONS

This application claims priority to U.S. Provisional Patent Appln. No. 62/487,953 filed Apr. 20, 2017, entitled "Device for the Generation of Digital Waveforms with High Resolution Duty Cycle for Creating Digital Waveform Driven Mass Filters," which is incorporated by reference in its entirety. U.S. patent application Ser. No. 15/316,900 filed Dec. 7, 2016, entitled "Digital Waveform Manipulations to Produce MS" Collision Induced Dissociation" is also incorporated by reference in its entirety.

BACKGROUND

Mass spectrometers are currently used to detect the presence of one or more compounds and quantify the amount of such compounds in a sample. The detection and quantification of compounds to a high degree of accuracy and precision, and the detection and quantification of high molecular weight compounds, is desired. Described herein are improvements in technology and solutions to technical problems that can be used to, among other things, increase the accuracy and precision of compound detection and quantification using a mass spectrometer.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference numbers in different figures indicates similar or identical items. The systems depicted in the accompanying figures are not to scale and components within the figures may be depicted not to scale with each other.

DETAILED DESCRIPTION

Figure 1:
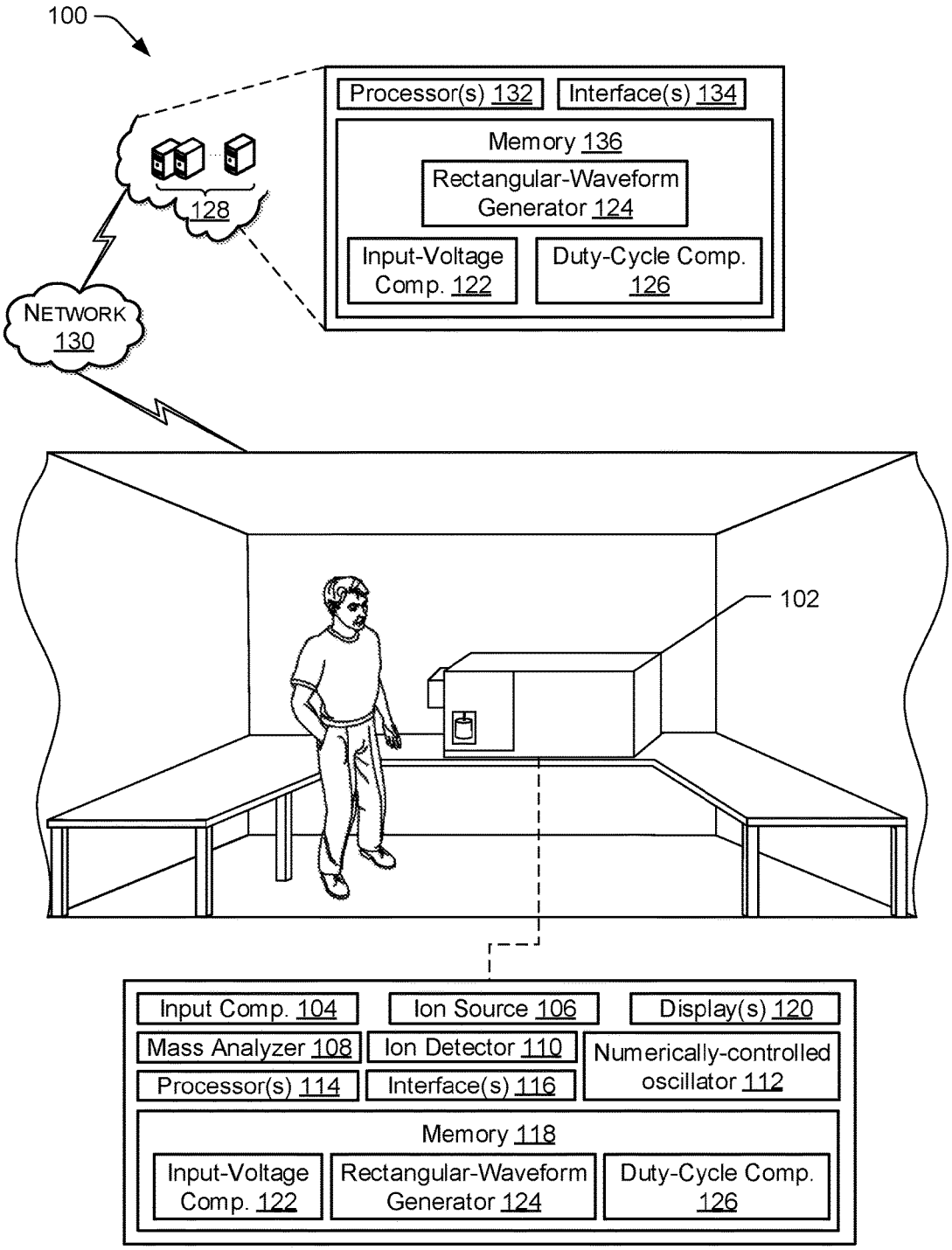
FIG. 1 illustrates a schematic diagram of an example environment for generation of digital waveforms with high-resolution duty cycles.

Systems and methods for generation of digital waveforms for high-resolution duty cycles are described herein. Take, for example, a mass spectrometer that is configured to receive an analyte, ionize the compounds associated with the analyte, and detect and/or quantify those compounds based at least in part on the molecular weights of the compounds. In this way, the mass spectrometer may be utilized to determine which compounds, based on their molecular weights, and how much of those compounds are present in a given analyte sample. However, mass spectrometers are limited in the range of molecular weights they are configured to detect as well as the resolution of molecular weights. For example, typical mass spectrometers are not able to detect compounds with molecular weights of 3,000 or more, while other mass spectrometers are specially designed to detect compounds with high molecular weights but cannot also detect lower molecular weights. By way of further example, mass spectrometers currently have a resolution that may allow for differentiation between compound molecular weights in the hundredths of a gram/mol. However, better resolution would be desirable for better differentiation between compounds and better quantification of detected compounds.

The present disclosure includes techniques that provide for better compound molecular weight distinction resolution than typical mass spectrometers and for an increased range of compound molecular weights that may be detected by mass spectrometers. For example, direct digital synthesis (DDS) techniques may be utilized to generate sinusoidal waveforms. Generally, the sinusoidal waveforms may be used to clock digital counters that may then generate rectangular waveforms that are amplified and then utilized to operate digitally-driven ion traps and/or ion guides. Rectangular waveforms may be created by holding current output high for a first number of ticks of the counter, also known as counter intervals, and then holding current output low for another second number of ticks of the counter. The frequency of the rectangular waveform may be the clock frequency divided by the total number of ticks counted. The frequency may be defined by the following Equation 1:

$$f=f_c/(n+m)$$

where n is the first number of ticks, m is the second number of ticks, and $f_c$ is the clock frequency.

The duty cycle of the waveform may be defined by the following Equation 2:

$$DC=n/(n+m)$$

where n is the first number of ticks and m is the second number of ticks.

The duty cycle may be precisely defined given the Equation 2, above, but the resolution at which the duty cycle may be defined is limited by the frequency of the clock and the total number of ticks counted.

To improve upon the duty cycle resolution provided by the DDS methods described above, the systems and methods described herein may generate precise rectangular waveforms with high duty-cycle resolution in a way that may utilize a low-voltage waveform generation system. The generation of rectangular waveforms with high duty-cycle resolution may be utilized for digital waveform technology (DWT)-based mass spectrometry. For example, the techniques described herein may be utilized to generate digital-waveform-based mass filters. Additionally, or alternatively, the high duty-cycle resolution may allow for increased isolation of targeted ions, such as in ion traps and/or may increase control of beam energy of the ions during axial ejection from linear quadrupole ion traps.

For example, the systems and methods described herein may generate sinusoidal waveforms, such as smoothed sinusoidal waveforms and may introduce these waveforms to a comparator. The comparator may take the voltage values of the smoothed sinusoidal waveform and may compare those voltage values to a reference voltage value. In doing so, the comparator may output a high value when the input voltage of the smoothed sinusoidal waveform is greater than or equal to the reference voltage. The comparator may also output a low value when the input voltage of the smoothed sinusoidal waveform is less than the reference voltage.

In these examples, the sinusoidal waveform may oscillate between a positive and negative voltage over time. The comparator may compare two input voltages. For example, one of the voltages may be from the sinusoidal waveform and the other may be set by a digital to analog convertor (DAC). When the voltage amplitude of the sinusoidal waveform is greater than or equal to the reference voltage set by the DAC, the comparator may output the high value. When the voltage amplitude of the sinusoidal waveform is less than the reference voltage set by the DAC, the comparator may output the low value. In instances where the reference voltage set by the DAC is ground, or zero volts, the resulting output may be a square waveform because the sinusoidal waveform will have the same number of high values as low values, but oscillating over time. In other examples, the reference voltage may be set above or below ground. In these examples, the resulting output may be a rectangular waveform because the sinusoidal waveform will have more high values than low values over time in instances where the reference voltage is below ground, and the sinusoidal waveform will have more low values than high values over time in instances where the reference voltage is above ground. The duty cycle may be defined by the fraction of time that the rectangular waveform is in the high state. As such, by setting the reference voltage below ground, the fraction of time that the rectangular waveform is in the high state may increase, which may increase the duty cycle. Additionally, by setting the reference voltage above ground, the fraction of time that the rectangular waveform is in the high state may decrease, which may decrease the duty cycle. In examples, the relationship between the reference voltage and the duty cycle may be defined by the following Equation 3:

$$DC=(\cos^{-1}V_c/N)$$

Where $V_c$ is the reference voltage set by the DAC and V is the zero-to-peak voltage of the sinusoidal waveform. Similar equations may be relative to waveform that are other than sinusoidal waveforms.

In examples, the resolution of the duty cycles produced utilizing the systems and methods described herein may depend on the voltage resolution of the DAC, the resolution of the comparator, and the voltage of the sinusoidal waveform. In examples where the full-scale peak-to-peak voltage of the sinusoidal waveform is 10 volts, a 16-bit DAC may parse the −5 volt to +5 volt output of the sinusoidal waveform by 0.15 millivolts (mVs). By way of further example, a comparator may have a voltage discrimination of about 0.3 mV. Utilizing the sinusoidal waveform voltage, DAC resolution, and comparator resolution described in this example, a mass filter may be generated with a resolution power of approximately 5,000 as determined from the following Equation 4:

$$RP=\delta/(11.5\cdot\delta_o\cdot|\delta_o-\delta|)$$

where δ is the operating duty cycle, $\delta_o$ is the duty cycle at the asymptote, which is 0.612099. Beyond this asymptotic limit, no ions may be transmitted through the mass analyzer to the ion detector of the mass spectrometer.

By producing the rectangular waveforms described herein, two-dimensional and/or three-dimensional ion traps and/or linear ion guides may be utilized. Two-dimensional ion traps and/or ion guides may utilize two rectangular waveforms to operate. In these two-dimensional examples, the duty cycle for each of the waveforms may be controllable with its own DAC and comparator. In examples, the sinusoidal waveform for each portion of the ion trap and/or ion guide may be used to generate both rectangular waveforms by using the complement of the comparator and/or by inverting the output for one of the sinusoidal waveforms. In these examples, the rectangular waveforms applied to the mass analyzer of the mass spectrometer may have four constant voltage intervals. During the first interval, the first electrode set of the mass analyzer may be high and the second electrode set may be low. During the second interval, all electrodes may produce a voltage at the same potential. During the third interval, the first electrode set may be low while the second electrode set may be high. During the fourth interval, all electrodes may produce a voltage at the same potential.

Utilizing the systems and methods described herein, for example, computer-readable media storing computer-executable instructions may cause one or more processors to perform one or more operations. The operations may include setting an input voltage value to be applied to a mass analyzer. The input voltage value may be above ground or below ground, for example. The operations may additionally include generating a smoothed sinusoidal waveform associated with the input voltage value. The sinusoidal waveform may be configured for use by the mass analyzer to target analysis of a compound, such as via an ion trap and/or an ion guide. The operations may also include determining a first portion of the smoothed sinusoidal waveform that is associated with a first set of voltage values above the input voltage value, and determining a second portion of the smoothed sinusoidal waveform that is associated with a second set of voltage values that are at least one of equal to or below the input voltage value. The operations may further include generating a rectangular waveform from the first set of voltage values and the second set of voltage values. In these examples, a high value of the rectangular waveform may represent the first set of voltage values and a low value of the rectangular waveform may represent the second set of voltage values. The operations may further include increasing or decreasing a duty cycle associated with the mass analyzer based at least in part on the rectangular waveform and receiving data from an ion detector indicating detection of ions passing through the mass analyzer.

The present disclosure provides an overall understanding of the principles of the structure, function, manufacture, and use of the systems and methods disclosed herein. One or more examples of the present disclosure are illustrated in the accompanying drawings. Those of ordinary skill in the art will understand that the systems and methods specifically described herein and illustrated in the accompanying drawings are non-limiting embodiments. The features illustrated or described in connection with one embodiment may be combined with the features of other embodiments, including as between systems and methods. Such modifications and variations are intended to be included within the scope of the appended claims.

Additional details are described below with reference to several example embodiments.

FIG. 1 illustrates a schematic diagram of an example system 100 for generation of digital waveforms for high-resolution duty cycles. The system 100 may include, for example, a mass spectrometer 102. The mass spectrometer 102 may include components such as, for example, an input component 104, an ion source 106, a mass analyzer 108, an ion detector 110, a numerically-controlled oscillator 112, one or more processors 114, one or more network interfaces 116, memory 118, and/or one or more displays 120. The memory 118 may include one or more components, such as, for example, an input-voltage component 122, a rectangular-waveform generator 124, and/or a duty-cycle component 126. Each of these components of the mass spectrometer 102 will be described in detail below. Additionally, in examples, the mass spectrometer 102 may be configured to send and receive data from a remote system 128, such as via a network 130. The remote system 128 may include components such as, for example, one or more processors 132, one or more network interfaces 134, and memory 136. The memory 136 may include one or more components, such as, for example, an instance of the input-voltage component 122, the rectangular-waveform generator 124, and/or the duty-cycle component 126. Each of these components of the remote system 128 will be described in detail below.

The environment 100 depicted in FIG. 1 may be described, by way of example, given the following use of the mass spectrometer 102 and/or the remote system 128. For example, a user of the mass spectrometer 102 may prepare an analyte to be analyzed by the mass spectrometer 102. The user may introduce at least a portion of the analyte into the mass spectrometer 102, such as via the input component 104 of the mass spectrometer 102. The input component 104 may be configured to accept the analyte and further prepare the analyte for analysis by the mass spectrometer 102. A preparation technique may include, for example, nebulizing the analyte.

The ion source 106 of the mass spectrometer 102 may generate ions and/or otherwise cause ions to interact with the analyte. This process may cause at least a portion of the analyte to be ionized and/or otherwise enter an excited state. Ionization methods may include, for example, electron impact ionization, chemical ionization, negative ion chemical ionization, electrospray ionization techniques, matrix-assisted laser desorption, and/or atmospheric pressure chemical ionization.

The analyte ions may then enter the mass analyzer 108 of the mass spectrometer 102. Examples of mass analyzers 108 may include, for example, one or more quadrupoles, time-of-flight components, ion traps, magnetic sector, and/or a combination thereof. The use of multiple mass analyzers 108 may be described as tandem mass spectrometry. Using quadrupoles as an example, the mass analyzer 108 may be configured to guide the analyte ions or a portion thereof through the mass analyzer 108 to the ion detector 110. For example, a quadrupole may comprise four parallel metal rods. Two opposite rods of the four rods may have an applied potential of (U+V cos (wt)) and the other two rods may have a potential of −(U+V cos (wt)), where U is a dc voltage and V cos (wt) is an ac voltage. The voltages applied to the metal rods may affect the trajectory of analyte ions traveling down the flight path centered between the four rods as those analyte ions interact with the current. For a given dc and ac voltage, ions of a certain mass-to-charge ratio may pass through the mass analyzer 108, while other ions may be thrown out or otherwise may exit the centered flight path. However, as described more fully herein, the applied voltage on the quadrupole and the capability of the quadrupole are limited based on the duty cycles associated with the current applied to the rods of the quadrupole.

The techniques described herein improve duty-cycle resolution and thus allow for better compound molecular weight distinction resolution and for an increased range of compound molecular weights that may be detected utilizing the mass analyzer 108. For example, the memory 118 may store instructions that may cause the one or more processors 114 to perform operations to generate rectangular waveforms that may be utilized to increase or decrease the duty cycle. For example, the operations may include utilizing DDS techniques to generate sinusoidal waveforms. The input-voltage component 122 may be utilized to set the input voltage to be applied to the mass analyzer 108. Generally, sinusoidal waveforms may be used to clock digital counters that may then generate rectangular waveforms that are amplified and then utilized to operate digitally-driven ion traps and/or ion guides.

Thereafter, the rectangular-waveform generator 124 may be configured to generate rectangular waveforms by holding current output high for a first number of ticks of the counter, also known as counter intervals, and then holding current output low for another second number of ticks of the counter. The frequency of the rectangular waveform may be the clock frequency divided by the total number of ticks counted. The frequency may be defined by Equation 1, described above.

The duty-cycle component 126 may be configured to identify, determine, and/or generate the duty cycle for current applied to the mass analyzer 108. The duty cycle of the waveform may be defined by Equation 2, also described above. The duty cycle may be precisely defined given Equation 2, above, but the resolution at which the duty cycle may be defined may be limited by the frequency of the clock and the total number of ticks counted.

For example, the systems and methods described herein may generate sinusoidal waveforms, such as smoothed sinusoidal waveforms and may introduce these waveforms to a comparator, which may be described as a component of the rectangular-waveform generator 124. The comparator may take the voltage values of the smoothed sinusoidal waveform and may compare those voltage values to a reference voltage value. In doing so, the comparator may output a high value when the input voltage of the smoothed sinusoidal waveform is greater than or equal to the reference voltage. The comparator may also output a low value when the input voltage of the smoothed sinusoidal waveform is less than the reference voltage.

In these examples, the sinusoidal waveform may oscillate between a positive and negative voltage over time. The comparator may compare two input voltages. For example, one of the voltages may be from the sinusoidal waveform and the other may be set by a DAC. When the voltage amplitude of the sinusoidal waveform is greater than or equal to the reference voltage set by the DAC, the comparator may output the high value. When the voltage amplitude of the sinusoidal waveform is less than the reference voltage set by the DAC, the comparator may output the low value. In instances where the reference voltage set by the DAC is ground, or zero volts, the resulting output may be a square waveform because the sinusoidal waveform will have the same number of high values as low values, but oscillating over time. In other examples, the reference voltage may be set above or below ground. In these examples, the resulting output may be a rectangular waveform because the sinusoidal waveform will have more high values than low values over time in instances where the reference voltage is below ground, and the sinusoidal waveform will have more low values than high values over time in instances where the reference voltage is above ground. The duty-cycle component 126 may utilize the rectangular waveform to increase or decrease the duty cycle resolution. The duty cycle may be defined by the fraction of time that the rectangular waveform is in the high state. As such, by setting the reference voltage below ground, the fraction of time that the rectangular waveform is in the high state may increase, which may increase the duty cycle. Additionally, by setting the reference voltage above ground, the fraction of time that the rectangular waveform is in the high state may decrease, which may decrease the duty cycle. In examples, the relationship between the reference voltage and the duty cycle may be defined by Equation 3, described above. Similar equations may be relative to waveform that are other than sinusoidal waveforms.

In examples, the resolution of the duty cycles produced utilizing the systems and methods described herein may depend on the voltage resolution of the DAC, the resolution of the comparator, and the voltage of the sinusoidal waveform. In examples where the full-scale peak-to-peak voltage of the sinusoidal waveform is 10 volts, a 16-bit DAC may parse the −5 volt to +5 volt output of the sinusoidal waveform by 0.15 millivolts (mVs). By way of further example, a comparator may have a voltage discrimination of about 0.3 mV. Utilizing the sinusoidal waveform voltage, DAC resolution, and comparator resolution described in this example, a mass filter may be generated with a resolution power of approximately 5,000 as determined from Equation 4, described above.

By producing the rectangular waveforms described herein, two-dimensional and/or three-dimensional ion traps and/or linear ion guides may be utilized. Two-dimensional ion traps and/or ion guides may utilize two rectangular waveforms to operate. In these two-dimensional examples, the duty cycle for each of the waveforms may be controllable with its own DAC and comparator. In examples, the sinusoidal waveform for each portion of the ion trap and/or ion guide may be used to generate both rectangular waveforms by using the complement of the comparator and/or by inverting the output for one of the sinusoidal waveforms. In these examples, the rectangular waveforms applied to the mass analyzer of the mass spectrometer may have four constant voltage intervals. During the first interval, the first electrode set of the mass analyzer may be high and the second electrode set may be low. During the second interval, all electrodes may produce a voltage at the same potential. During the third interval, the first electrode set may be low while the second electrode set may be high. During the fourth interval, all electrodes may produce a voltage at the same potential.

The numerically-controlled oscillators 112 may be configured to oscillate current associated with the mass analyzer 108. For example, a number of steps through a phase accumulator of the numerically-controlled oscillator 112 may be set, and the numerically-controlled oscillator 112 may be utilized to oscillate an electronic signal at a frequency based at least in part on a frequency control word. The operations performed by the processors 114 may include converting one or more output values from the phase accumulator to one or more amplitudes and generating, based at least in part on the DAC, a sinusoidal waveform from the one or more amplitudes. The smoothed sinusoidal waveform may be generated based at least in part on the sinusoidal waveform as filtered by a low-pass filter.

The displays 120 may be utilized to present information associated with analysis of the analyte and/or may be utilized to accept input, such as user input from a touch-screen, to impact analysis of the analyte.

Additionally, or alternatively, the processors 132 of the remote system 128 may be configured, utilizing the memory 136, to perform one or more of the operations described above with respect to the mass spectrometer 102. For example, the operations performed with respect to the input-voltage component 122, the rectangular-waveform generator 124, and/or the duty-cycle component 126 may be performed in whole or in part by the remote system 128. In these examples, data associated with analysis of the analyte may be sent and/or received between the mass spectrometer 102 and the remote system 128, such as via the network 130.

As used herein, a processor, such as processor(s) 114 and 132, may include multiple processors and/or a processor having multiple cores. Further, the processors may comprise one or more cores of different types. For example, the processors may include application processor units, graphic processing units, and so forth. In one implementation, the processor may comprise a microcontroller and/or a microprocessor. The processor(s) 114 and 132 may include a graphics processing unit (GPU), a microprocessor, a digital signal processor or other processing units or components known in the art. Alternatively, or in addition, the functionally described herein can be performed, at least in part, by one or more hardware logic components. For example, and without limitation, illustrative types of hardware logic components that can be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, each of the processor(s) 104 may possess its own local memory, which also may store program components, program data, and/or one or more operating systems.

The memory 118 and 136 may include volatile and nonvolatile memory, removable and non-removable media implemented in any method or technology for storage of information, such as computer-readable instructions, data structures, program component, or other data. Such memory 118 and 136 includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device. The memory 118 and 136 may be implemented as computer-readable storage media ("CRSM"), which may be any available physical media accessible by the processor(s) 114 and 132 to execute instructions stored on the memory 118 and 136. In one basic implementation, CRSM may include random access memory ("RAM") and Flash memory. In other implementations, CRSM may include, but is not limited to, read-only memory ("ROM"), electrically erasable programmable read-only memory ("EEPROM"), or any other tangible medium which can be used to store the desired information and which can be accessed by the processor(s).

Further, functional components may be stored in the respective memories, or the same functionality may alternatively be implemented in hardware, firmware, application specific integrated circuits, field programmable gate arrays, or as a system on a chip (SoC). In addition, while not illustrated, each respective memory, such as memory 118 and 136, discussed herein may include at least one operating system (OS) component that is configured to manage hardware resource devices such as the network interface(s), the I/O devices of the respective apparatuses, and so forth, and provide various services to applications or components executing on the processors. Such OS component may implement a variant of the FreeBSD operating system as promulgated by the FreeBSD Project; other UNIX or UNIX-like variants; a variation of the Linux operating system as promulgated by Linus Torvalds; the FireOS operating system from Amazon.com Inc. of Seattle, Wash., USA; the Windows operating system from Microsoft Corporation of Redmond, Wash., USA; LynxOS as promulgated by Lynx Software Technologies, Inc. of San Jose, Calif.; Operating System Embedded (Enea OSE) as promulgated by ENEA AB of Sweden; and so forth.

The network interface(s) 116 and 134 may enable communications between the components and/or devices shown in system 100 and/or with one or more other remote systems, as well as other networked devices. Such network interface(s) 116 and 134 may include one or more network interface controllers (NICs) or other types of transceiver devices to send and receive communications over the network 130.

For instance, each of the network interface(s) 116 and 134 may include a personal area network (PAN) component to enable communications over one or more short-range wireless communication channels. For instance, the PAN component may enable communications compliant with at least one of the following standards IEEE 802.15.4 (ZigBee), IEEE 802.15.1 (Bluetooth), IEEE 802.11 (WiFi), or any other PAN communication protocol. Furthermore, each of the network interface(s) 116 and 134 may include a wide area network (WAN) component to enable communication over a wide area network.

Figure 2:
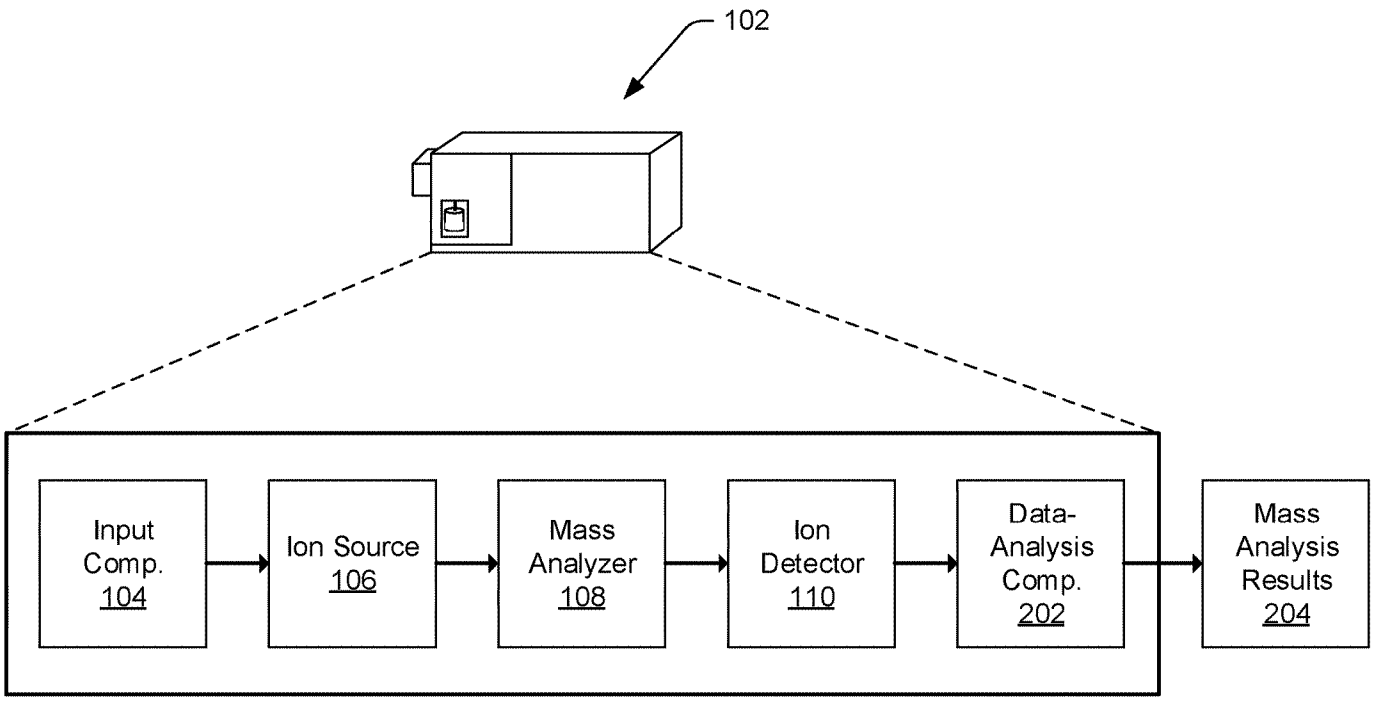
FIG. 2 illustrates a schematic diagram of an example mass spectrometer that may utilize digital waveforms with high-resolution duty cycles.

FIG. 2 illustrates a schematic diagram of an example mass spectrometer 102 that may utilize digital waveforms with high-resolution duty cycles. The mass spectrometer 102 may include components such as an input component 104, an ion source 106, a mass analyzer 108, an ion detector 110, and/or a data-analysis component 202. The input component 104, ion source 106, mass analyzer 108, and ion detector 110 may include the same or similar components and/or perform the same or similar functions as described with respect to FIG. 1.

The data-analysis component 202 may perform functions similar to the processors 114 of the mass spectrometer 102 as described with respect to FIG. 1. For example, the operations performed by the data-analysis component 202 may include utilizing DDS techniques to generate sinusoidal waveforms. An input voltage may be set to be applied to the mass analyzer 108. Generally, sinusoidal waveforms may be used to clock digital counters that may then generate rectangular waveforms that are amplified and then utilized to operate digitally-driven ion traps and/or ion guides.

The data-analysis component 202 may generate a smoothed sinusoidal waveform and may introduce these waveforms to a comparator. The comparator may take the voltage values of the smoothed sinusoidal waveform and may compare those voltage values to a reference voltage value. In doing so, the comparator may output a high value when the input voltage of the smoothed sinusoidal waveform is greater than or equal to the reference voltage. The comparator may also output a low value when the input voltage of the smoothed sinusoidal waveform is less than the reference voltage.

In these examples, the sinusoidal waveform may oscillate between a positive and negative voltage over time. The comparator may compare two input voltages. For example, one of the voltages may be from the sinusoidal waveform and the other may be set by a DAC. When the voltage amplitude of the sinusoidal waveform is greater than or equal to the reference voltage set by the DAC, the comparator may output the high value. When the voltage amplitude of the sinusoidal waveform is less than the reference voltage set by the DAC, the comparator may output the low value. In instances where the reference voltage set by the DAC is ground, or zero volts, the resulting output may be a square waveform because the sinusoidal waveform will have the same number of high values as low values, but oscillating over time. In other examples, the reference voltage may be set above or below ground. In these examples, the resulting output may be a rectangular waveform because the sinusoidal waveform will have more high values than low values over time in instances where the reference voltage is below ground, and the sinusoidal waveform will have more low values than high values over time in instances where the reference voltage is above ground. The rectangular waveform may be utilized to increase or decrease the duty cycle resolution. The duty cycle may be defined by the fraction of time that the rectangular waveform is in the high state. As such, by setting the reference voltage below ground, the fraction of time that the rectangular waveform is in the high state may increase, which may increase the duty cycle. Additionally, by setting the reference voltage above ground, the fraction of time that the rectangular waveform is in the high state may decrease, which may decrease the duty cycle.

Based at least in part on applying the rectangular waveform to current applied to the mass analyzer to improve duty-cycle resolution, ions that pass through the mass analyzer may be detected by the ion detector 110. The data-analysis component 202 may be utilized to process input from the ion detector 110 indicative of ions hitting the ion detector 110. The input may be converted to mass analysis results 204, which may include a report, data, or other representation of the detection of the analyte ions. The mass analysis results 204 may include an indication of the molecular weight of the ions detected and/or the quantity of the ions detected, such as compared to a baseline and/or to other detected ions.

Figure 3:
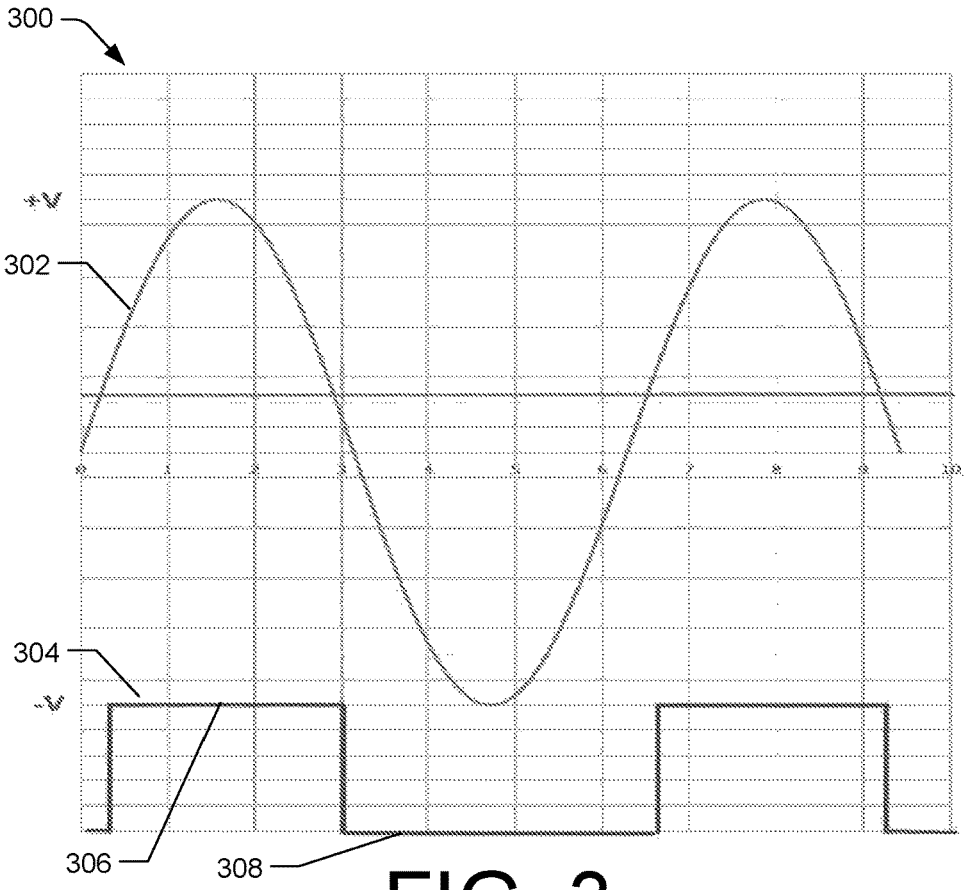
FIG. 3 illustrates a graph depicting a sinusoidal waveform and a corresponding generated rectangular digital waveform.

FIG. 3 illustrates a graph 300 depicting a sinusoidal waveform 302 and a corresponding generated rectangular digital waveform 304. The sinusoidal waveform 302 may oscillate between a positive and negative voltage over time, as shown in FIG. 3. A comparator, as described more fully herein, may compare two input voltages. For example, one of the voltages may be from the sinusoidal waveform 302 and the other may be set by a DAC. When the voltage amplitude of the sinusoidal waveform 302 is greater than or equal to the reference voltage set by the DAC, the comparator outputs a high value 306. When the voltage amplitude of the sinusoidal waveform is less than the reference voltage set by the DAC, the comparator may output a low value 308. In instances where the reference voltage set by the DAC is ground, or zero volts, the resulting output may be a square waveform because the sinusoidal waveform 302 will have the same number of high values 306 as low values 308, but oscillating over time. In other examples, the reference voltage may be set above or below ground. In these examples, the resulting output may be a rectangular waveform because the sinusoidal waveform 302 will have more high values 306 than low values 308 over time in instances where the reference voltage is below ground, and the sinusoidal waveform 302 will have more low values 308 than high values 306 over time in instances where the reference voltage is above ground.

Figure 4:
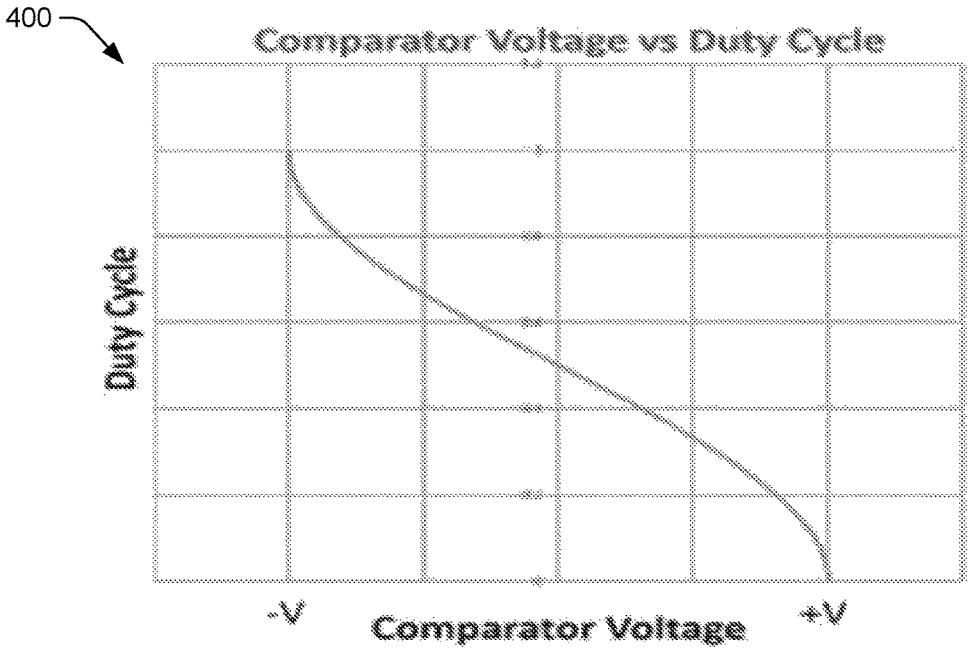
FIG. 4 illustrates a graph comparing comparator voltage to duty cycles for sinusoidal wave input.

FIG. 4 illustrates a graph 400 comparing comparator voltage to duty cycles for sinusoidal wave input. Graph 400 shows the relationship between the reference voltage and the duty cycle, which may be defined by Equation 3, presented above. In examples, the resolution of the duty cycles produced utilizing the systems and methods described herein may depend on the voltage resolution of the DAC, the resolution of the comparator, and the voltage of the sinusoidal waveform. In examples where the full-scale peak-to-peak voltage of the sinusoidal waveform is 10 volts, a 16-bit DAC may parse the −5 volt to +5 volt output of the sinusoidal waveform by 0.15 millivolts (mVs). By way of further example, a comparator may have a voltage discrimination of about 0.3 mV. Utilizing the sinusoidal waveform voltage, DAC resolution, and comparator resolution described in this example, a mass filter may be generated with a resolution power of approximately 5,000.

Figure 5:
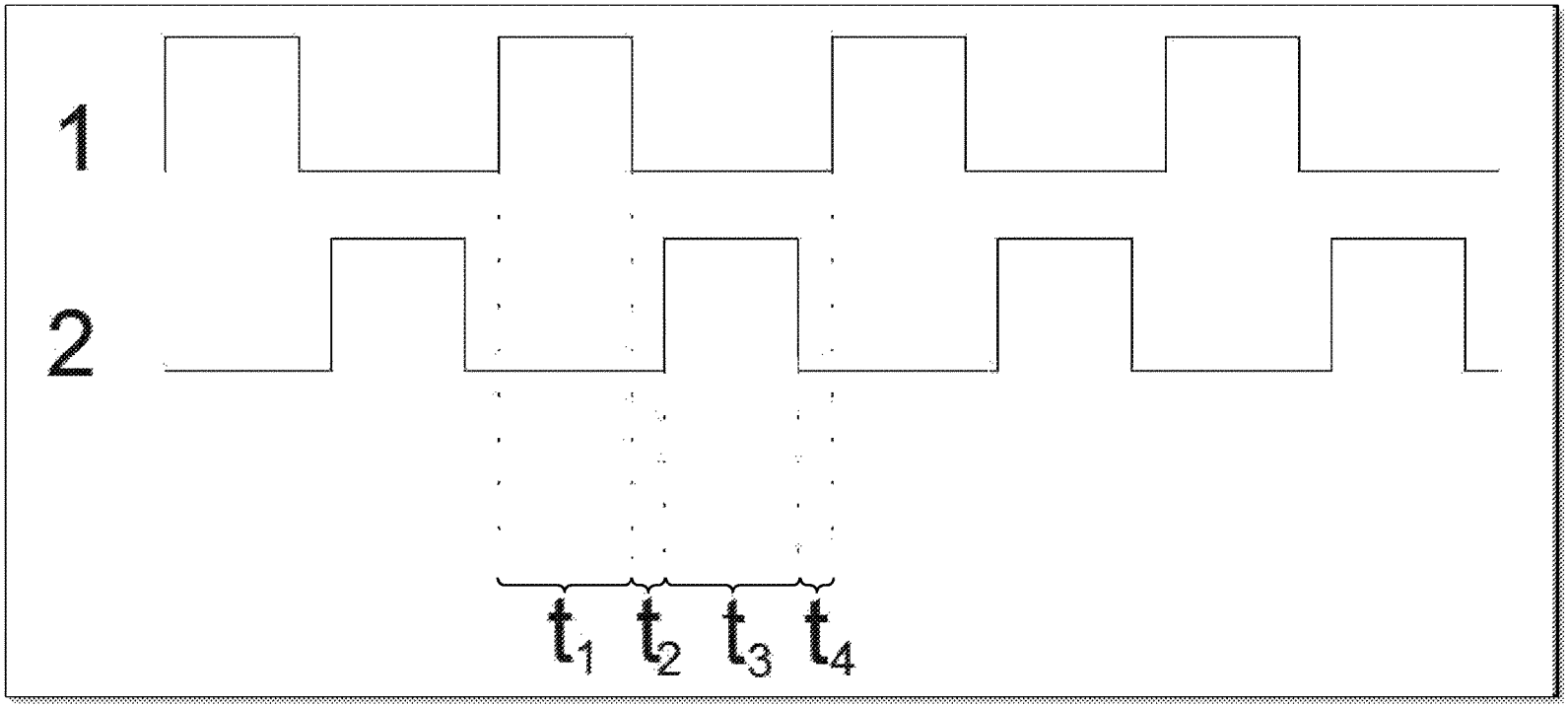
FIG. 5 illustrates two rectangular waveforms generated for use in a two-dimensional ion trap and/or ion guide.

FIG. 5 illustrates two rectangular waveforms generated for use in a two-dimensional ion trap and/or ion guide. By producing the rectangular waveforms described herein, two-dimensional and/or three-dimensional ion traps and/or linear ion guides may be utilized. Two-dimensional ion traps and/or ion guides may utilize two rectangular waveforms to operate. In these two-dimensional examples, the duty cycle for each of the waveforms may be controllable with its own DAC and comparator. In examples, the sinusoidal waveform for each portion of the ion trap and/or ion guide may be used to generate both rectangular waveforms by using the complement of the comparator and/or by inverting the output for one of the sinusoidal waveforms. In these examples, the rectangular waveforms applied to the mass analyzer of the mass spectrometer may have four constant voltage intervals. During the first interval, the first electrode set of the mass analyzer may be high and the second electrode set may be low. During the second interval, all electrodes may produce a voltage at the same potential. During the third interval, the first electrode set may be low while the second electrode set may be high. During the fourth interval, all electrodes may produce a voltage at the same potential.

The rectangular waveforms generated as described above are illustrated in FIG. 5. The four intervals described above are illustrated as $t_1$, $t_2$, $t_3$, and $t_4$ in FIG. 5. In examples, $t_1$ and $t_3$ may be utilized in a similar manner as described for three-internal waveforms in defining the radial stability and $t_2$ and $t_4$ may be utilized in a similar manner as described for $t_2$ in defining axial ejection and trapping of ions. If, in examples, a single fundamental waveform is used to generate both waveforms applied to both electrode sets in a quadrupole, then $t_2$ may equal $t_4$. In other examples where a second fundamental waveform is utilized with the same frequency but a different and controllable phase, then the values of $t_2$ and $t_4$ may vary.

Figure 6:
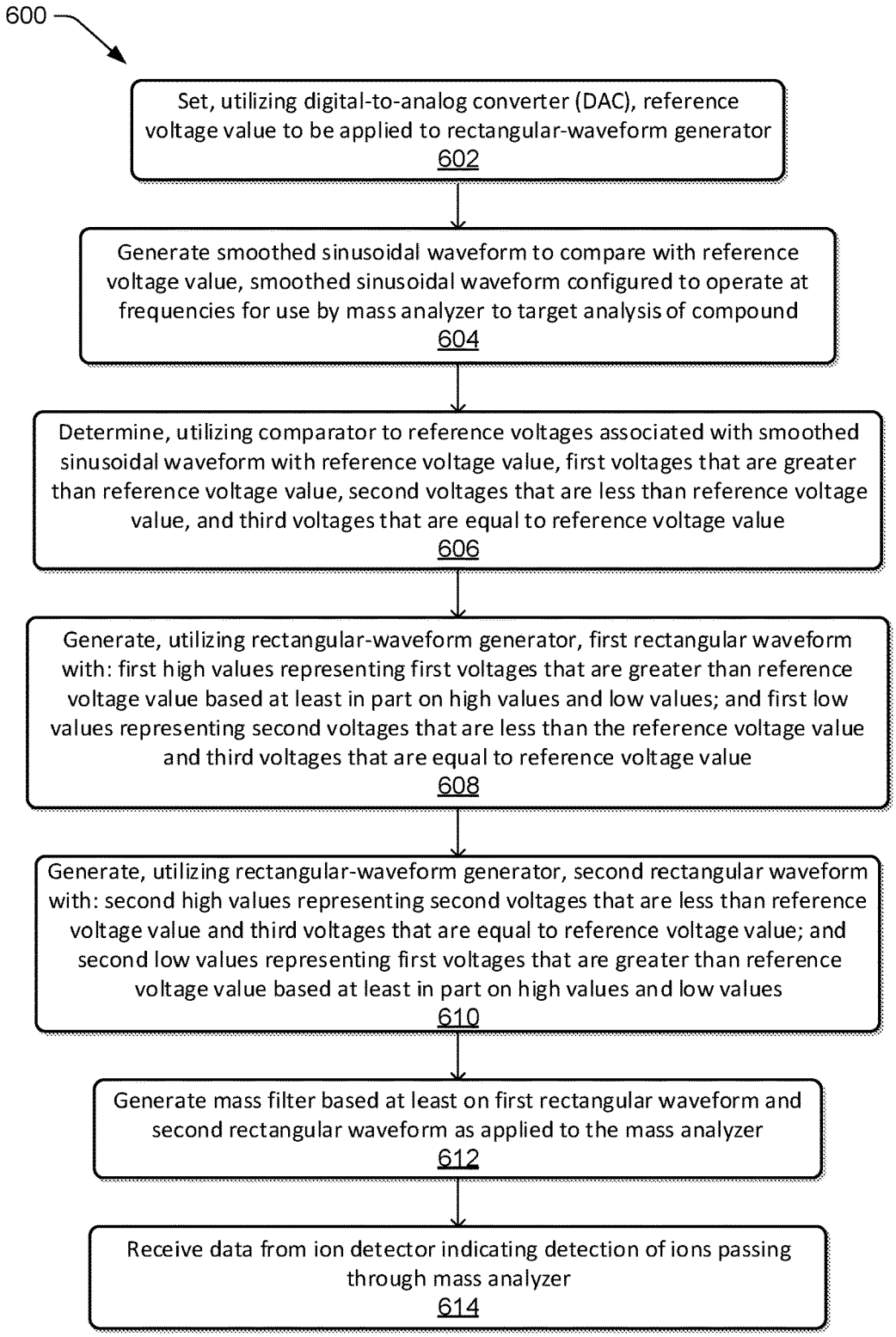
FIG. 6 illustrates a flow diagram of an example process for generating digital waveforms for high-resolution duty cycles.
Figure 7:
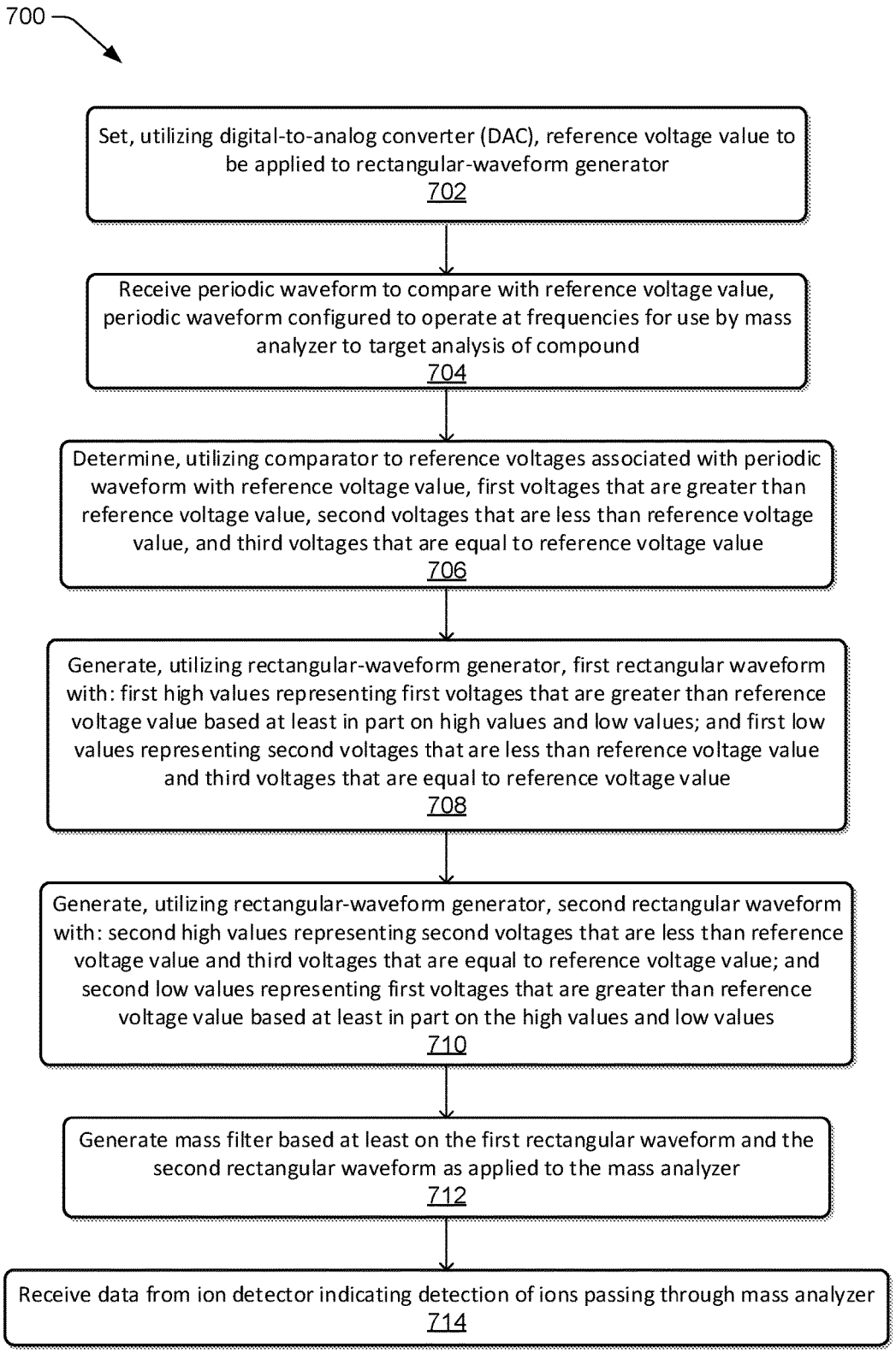
FIG. 7 illustrates a flow diagram of another example process for generating digital waveforms for high-resolution duty cycles.

FIGS. 6 and 7 illustrate various processes for generating digital waveforms for high-resolution duty cycles. The processes described herein are illustrated as collections of blocks in logical flow diagrams, which represent a sequence of operations, some or all of which may be implemented in hardware, software or a combination thereof. In the context of software, the blocks may represent computer-executable instructions stored on one or more computer-readable media that, when executed by one or more processors, program the processors to perform the recited operations. Generally, computer-executable instructions include routines, programs, objects, components, data structures and the like that perform particular functions or implement particular data types. The order in which the blocks are described should not be construed as a limitation, unless specifically noted. Any number of the described blocks may be combined in any order and/or in parallel to implement the process, or alternative processes, and not all of the blocks need be executed. For discussion purposes, the processes are described with reference to the environments, architectures and systems described in the examples herein, such as, for example those described with respect to FIGS. 1-5, although the processes may be implemented in a wide variety of other environments, architectures and systems.

FIG. 6 illustrates a flow diagram of an example process for generating digital waveforms for high-resolution duty cycles. The order in which the operations or steps are described is not intended to be construed as a limitation, and any number of the described operations may be combined in any order and/or in parallel to implement process 600.

At block 602, the process 600 may include setting, utilizing a digital-to-analog converter (DAC), a reference voltage value to be applied to a rectangular-waveform generator. For example, an input-voltage component may be utilized to set the reference voltage to be applied to a mass analyzer. The reference voltage value may be set, for example, to above ground or below ground. In examples, the reference voltage may be set utilizing a DAC, as described more fully herein.

At block 604, the process 600 may include generating a smoothed sinusoidal waveform to compare with the reference voltage value, the smoothed sinusoidal waveform configured to operate at frequencies for use by the mass analyzer to target analysis of a compound. For example, a number of steps through a phase accumulator of a numerically-controlled oscillator of a mass spectrometer may be set. Oscillation of an electronic signal at a frequency based at least in part on a frequency control word may be performed. One or more output values from the phase accumulator may be associated with one or more amplitudes and a sinusoidal waveform may be generated based at least in part on the DAC from the one or more amplitudes. The smoothed sinusoidal waveform may be generated based at least in part on the sinusoidal waveform as filtered by a low-pass filter.

At block 606, the process 600 may include determining, utilizing a comparator to reference voltages associated with the smoothed sinusoidal waveform with the reference voltage value, first voltages that are greater than the reference voltage value, second voltages that are less than the reference voltage value, and third voltages that are equal to the reference voltage value. For example, the smoothed sinusoidal waveforms may be introduced to a comparator, which may be described as a component of the rectangular-waveform generator. The comparator may take the voltage values of the smoothed sinusoidal waveform and may compare those voltage values to the reference voltage value. In doing so, the comparator may output a high value when the input voltage of the smoothed sinusoidal waveform is greater than or equal to the reference voltage. The comparator may also output a low value when the input voltage of the smoothed sinusoidal waveform is less than the reference voltage. In other examples, the comparator may output a low value when the input voltage is less than the reference voltage, while the comparator may output a high value when the input voltage is greater than or equal to the reference voltage.

In these examples, the sinusoidal waveform may oscillate between a positive and negative voltage over time. The comparator may compare two input voltages. For example, one of the voltages may be from the sinusoidal waveform and the other may be set by the DAC. When the voltage amplitude of the sinusoidal waveform is greater than or equal to the reference voltage set by the DAC, the comparator may output the high value. When the voltage amplitude of the sinusoidal waveform is less than the reference voltage set by the DAC, the comparator may output the low value. In other examples, when the voltage amplitude of the sinusoidal waveform is less than the reference voltage set by the DAC, the comparator may output the low value, while a voltage amplitude of greater than or equal to the reference voltage set by the DAC may result in the output of a high value.

At block 608, the process 600 may include generating, utilizing the rectangular-waveform generator, a first rectangular waveform with: first high values representing the first voltages that are greater than the reference voltage value based at least in part on the high values and the low values; and first low values representing the second voltages that are less than the reference voltage value and the third voltages that are equal to the reference voltage value. Generation of the first rectangular waveform may be based on the determination made at block 606, above.

At block 610, the process 600 may include generating, utilizing the rectangular-waveform generator, a second rectangular waveform with: second high values representing the second voltages that are less than the reference voltage value and the third voltages that are equal to the reference voltage value; and second low values representing the first voltages that are greater than the reference voltage value based at least in part on the high values and the low values. Generation of the second rectangular waveform may be based on the determination made at block 606, above.

At block 612, the process 600 may include generating a mass filter based at least on the first rectangular waveform and the second rectangular waveform as applied to the mass analyzer, the first rectangular waveform and the second rectangular waveform defined based at least in part on a resolution of the DAC, a maximum amplitude of the smoothed sinusoidal waveform, and a minimum change in voltage to alter output of the comparator, wherein a duty cycle resolution associated with the first rectangular waveform and the second rectangular waveform is down to at least $1.9\times10^{-5}$, the mass filter is configured to filter ions associated with compounds with a molecular weight of about 1 gram/mol to about $1\times10^{9}$ grams/mol. For example, in instances where the reference voltage set by the DAC is ground, or zero volts, the resulting output may be a square waveform because the sinusoidal waveform will have the same number of high values as low values, but oscillating over time. In other examples, the reference voltage may be set above or below ground. In these examples, the resulting output may be a rectangular waveform because the sinusoidal waveform will have more high values than low values over time in instances where the reference voltage is below ground, and the sinusoidal waveform will have more low values than high values over time in instances where the reference voltage is above ground.

By way of example, a duty-cycle component may utilize the rectangular waveform to increase or decrease the duty cycle resolution. The duty cycle may be defined by the fraction of time that the rectangular waveform is in the high state. As such, by setting the reference voltage below ground, the fraction of time that the rectangular waveform is in the high state may increase, which may increase the duty cycle. Additionally, by setting the reference voltage above ground, the fraction of time that the rectangular waveform is in the high state may decrease, which may decrease the duty cycle. In examples, the resolution of the duty cycles produced utilizing the systems and methods described herein may depend on the voltage resolution of the DAC, the resolution of the comparator, and the voltage of the sinusoidal waveform. By way of example, the duty cycle may be set based at least in part on Equation 3, described above. Utilizing the rectangular waveforms described herein to control duty cycles, the duty cycle resolution may be at least, for example, $1.9\times10^{-5}$. Additionally, setting the duty cycle resolution as described herein may result in detection of ions associated with a compound having molecular weight of about 1 gram/mol to about $1\times10^{9}$ grams/mol.

At block 614, the process 600 may include receiving data from the ion detector indicating detection of the ions passing through the mass analyzer. For example, the ion guide produced utilizing the methods and system described herein may allow for a narrow range of compounds to travel through the mass analyzer. Those ions may be detected by the ion detector.

The process 600 may additionally, or alternatively, include causing the first reference voltage value to increase or decrease to a second reference voltage value and applying the second reference voltage value to the rectangular-waveform generator such that ions associated with the compound become trapped within the mass analyzer.

The process 600 may additionally, or alternatively, include causing the first reference voltage value to increase or decrease to a second reference voltage value and applying the second reference voltage value to the rectangular-waveform generator such that at least a portion of the ions associated with the compound fracture into fractured ions. The process 600 may also include detecting, via the ion detector, the fractured ions. Detection of the fractured ions given the second reference voltage value may provide additional insight into the identity of the analyte.

FIG. 7 illustrates a flow diagram of another example process for generating digital waveforms for high-resolution duty cycles. The order in which the operations or steps are described is not intended to be construed as a limitation, and any number of the described operations may be combined in any order and/or in parallel to implement process 700.

At block 702, the process 700 may include setting, utilizing a digital-to-analog converter (DAC), a reference voltage value to be applied to a rectangular-waveform generator. For example, an input-voltage component may be utilized to set the reference voltage to be applied to a mass analyzer. The reference voltage value may be set, for example, to above ground or below ground. In examples, the reference voltage may be set utilizing a DAC, as described more fully herein.

At block 704, the process 700 may include receiving a periodic waveform to compare with a reference voltage value, the periodic waveform configured to operate at frequencies for use by the mass analyzer to target analysis of a compound. For example, a number of steps through a phase accumulator of a numerically-controlled oscillator of a mass spectrometer may be set. Oscillation of an electronic signal at a frequency based at least in part on a frequency control word may be performed. One or more output values from the phase accumulator may be associated with one or more amplitudes and a waveform may be generated based at least in part on the DAC from the one or more amplitudes.

The periodic waveform may be generated based at least in part on the waveform as filtered by a low-pass filter.

At block 706, the process 700 may include determining, utilizing a comparator to reference voltages associated with the periodic waveform with the reference voltage value, first voltages that are greater than the reference voltage value, second voltages that are less than the reference voltage value, and third voltages that are equal to the reference voltage value. For example, the periodic waveforms may be introduced to the comparator, which may be described as a component of the rectangular-waveform generator. The comparator may take the voltage values of the periodic waveform and may compare those voltage values to a reference voltage value. In doing so, the comparator may output a high value when the input voltage of the periodic waveform is greater than or equal to the reference voltage. The comparator may also output a low value when the input voltage of the periodic waveform is less than the reference voltage. In other examples, the comparator may output a low value when the input voltage is less than the reference voltage, while the comparator may output a high value when the input voltage is greater than or equal to the reference voltage.

In these examples, the periodic waveform may oscillate between a positive and negative voltage over time. The comparator may compare two input voltages. For example, one of the voltages may be from the periodic waveform and the other may be set by the DAC. When the voltage amplitude of the periodic waveform is greater than or equal to the reference voltage set by the DAC, the comparator may output the high value. When the voltage amplitude of the periodic waveform is less than the reference voltage set by the DAC, the comparator may output the low value. In other examples, when the voltage amplitude of the sinusoidal waveform is less than the reference voltage set by the DAC, the comparator may output the low value, while a voltage amplitude of greater than or equal to the reference voltage set by the DAC may result in the output of a high value.

At block 708, the process 700 may include generating, utilizing the rectangular-waveform generator, a first rectangular waveform with: first high values representing the first voltages that are greater than the reference voltage value based at least in part on the high values and the low values; and first low values representing the second voltages that are less than the reference voltage value and the third voltages that are equal to the reference voltage value. Generation of the first rectangular waveform may be based on the determination made at block 706, above.

At block 710, the process 700 may include generating, utilizing the rectangular-waveform generator, a second rectangular waveform with: second high values representing the second voltages that are less than the reference voltage value and the third voltages that are equal to the reference voltage value; and second low values representing the first voltages that are greater than the reference voltage value based at least in part on the high values and the low values. Generation of the second rectangular waveform may be based at least in part on the determination made at block 706, above.

At block 712, the process 700 may include generating a mass filter based at least on the first rectangular waveform and the second rectangular waveform as applied to the mass analyzer, the first rectangular waveform and the second rectangular waveform defined based at least in part on a resolution of the DAC, a maximum amplitude of the smoothed sinusoidal waveform, and a minimum change in voltage to alter output of the comparator, wherein a duty cycle resolution associated with the first rectangular waveform and the second rectangular waveform is down to at least $1.9\times10^{-5}$, the mass filter is configured to filter ions associated with compounds with a molecular weight of about 1 gram/mol to about $1\times10^{9}$ grams/mol. For example, in instances where the reference voltage set by the DAC is ground, or zero volts, the resulting output may be a square waveform because the periodic waveform will have the same number of high values as low values, but oscillating over time. In other examples, the reference voltage may be set above or below ground. In these examples, the resulting output may be a rectangular waveform because the periodic waveform will have more high values than low values over time in instances where the reference voltage is below ground, and the periodic waveform will have more low values than high values over time in instances where the reference voltage is above ground. By way of example, the duty cycle may be set based at least in part on Equation 3, described above.

By way of example, a duty-cycle component may utilize the rectangular waveform to increase or decrease the duty cycle resolution. The duty cycle may be defined by the fraction of time that the rectangular waveform is in the high state. As such, by setting the reference voltage below ground, the fraction of time that the rectangular waveform is in the high state may increase, which may increase the duty cycle. Additionally, by setting the reference voltage above ground, the fraction of time that the rectangular waveform is in the high state may decrease, which may decrease the duty cycle. In examples, the resolution of the duty cycles produced utilizing the systems and methods described herein may depend on the voltage resolution of the DAC, the resolution of the comparator, and the voltage of the sinusoidal waveform. Utilizing the rectangular waveforms described herein to control duty cycles, the duty cycle resolution may be at least, for example, $1.9\times10^{-5}$. Additionally, setting the duty cycle resolution as described herein may result in detection of ions associated with a compound having molecular weight of about 1 gram/mol to about $1\times10^{9}$ grams/mol.

At block 714, the process 700 may include receiving data from a ion detector indicating detection of the ions passing through the mass analyzer. For example, the ion guide produced utilizing the methods and system described herein may allow for a narrow range of compounds to travel through the mass analyzer. Those ions may be detected by the ion detector.

The process 700 may additionally, or alternatively, include setting a number of steps through a phase accumulator of a numerically-controlled oscillator of a mass spectrometer and causing oscillation of an electronic signal at a frequency based at least in part on a frequency control word. The process 700 may also include converting one or more output values from the phase accumulator to one or more amplitudes and generating, based at least in part on the DAC, a waveform from the one or more amplitudes. The process 700 may also include generating the periodic waveform based at least in part on the waveform as filtered by a low-pass filter.

The process 700 may additionally, or alternatively, include causing the first reference voltage value to increase or decrease to a second reference voltage value and applying the second reference voltage value to the rectangular-waveform generator such that the ions associated with the compound received at the mass analyzer become trapped within the mass analyzer.

The process 700 may additionally, or alternatively, include causing the first reference voltage value to increase or decrease to a second reference voltage value and applying the second reference voltage value to the rectangular-waveform generator such that at least a portion of ions associated with a compound received at the mass analyzer fracture into fractured ions. The process 700 may also include detecting, via the ion detector, the fractured ions. Detection of the fractured ions given the second reference voltage value may provide additional insight into the identity of the analyte.

The process 700 may additionally, or alternatively, include altering the rectangular waveform while the ions associated with the compound travel through a centerline of the mass analyzer and causing a stability of the ions to change based at least in part on altering the rectangular waveform. Altering the rectangular waveform may be performed at a rate of at least one of 5 microseconds or less than 5 microseconds.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative some embodiments that fall within the scope of the claims of the application.

What is claimed is:

1. A system, comprising:

an input component;

an ion source;

a mass analyzer;

an ion detector;

one or more processors; and computer-readable media storing computer-executable instructions that, when executed by the one or more processors, cause the one or more processors to perform operations comprising:

setting, utilizing a digital-to-analog converter (DAC), a reference voltage value to be applied to a rectangular-waveform generator;

generating a smoothed sinusoidal waveform to compare with the reference voltage value, the smoothed sinusoidal waveform configured to operate at frequencies for use by the mass analyzer to target analysis of a compound;

determining, utilizing a comparator to compare voltages of the smoothed sinusoidal waveform with the reference voltage value, first voltages that are greater than the reference voltage value, second voltages that are less than the reference voltage value, and third voltages that are equal to the reference voltage value;

generating, utilizing the rectangular-waveform generator, a first rectangular waveform with:

first high values representing when the first voltages are greater than the reference voltage value; and first low values representing when the second voltages are less than the reference voltage value and the third voltages are equal to the reference voltage value;

generating, utilizing the rectangular-waveform generator, a second rectangular waveform with:

second high values representing when the second voltages are less than the reference voltage value and the third voltages are equal to the reference voltage value; and second low values representing when the first voltages are greater than the reference voltage value;

generating a mass filter based at least on the first rectangular waveform and the second rectangular waveform as applied to the mass analyzer, the first rectangular waveform and the second rectangular waveform defined based at least in part on a resolution of the DAC, a maximum amplitude of the smoothed sinusoidal waveform, and a minimum change in voltage to alter output of the comparator, wherein a duty cycle resolution associated with the first rectangular waveform and the second rectangular waveform is down to at least $1.9\times10^{-5}$, the mass filter is configured to filter ions associated with compounds with a molecular weight of about 1 gram/mol to about $1\times10^{9}$ grams/mol; and receiving data from the ion detector indicating detection of the ions passing through the mass analyzer.

2. The system of claim 1, further comprising a numerically-controlled oscillator, and wherein the operations further comprise:

setting a number of steps through a phase accumulator of the numerically-controlled oscillator;

causing, via the numerically-controlled oscillator, oscillation of an electronic signal at a frequency based at least in part on a frequency control word;

converting one or more output values from the phase accumulator to one or more amplitudes;

generating, based at least in part on the DAC, a sinusoidal waveform from the one or more amplitudes; and wherein generating the smoothed sinusoidal waveform is based at least in part on the sinusoidal waveform as filtered by a low-pass filter.

3. The system of claim 1, wherein the reference voltage value comprises a first reference voltage value, and the operations further comprising:

causing the first reference voltage value to increase or decrease to a second reference voltage value; and applying the second reference voltage value to the rectangular-waveform generator such that the ions associated with the compound become trapped within the mass analyzer.

4. The system of claim 1, wherein the reference voltage value comprises a first reference voltage value, and the operations further comprising:

causing the first reference voltage value to increase or decrease to a second reference voltage value;

applying the second reference voltage value to the rectangular-waveform generator such that at least a portion of the ions associated with the compound fracture into fractured ions; and detecting, via the ion detector, the fractured ions.

5. A method, comprising:

setting, utilizing a digital-to-analog converter (DAC), a reference voltage value to be applied to a rectangular-waveform generator;

receiving a periodic waveform to compare with the reference voltage value, the periodic waveform configured to operate at frequencies for use by a mass analyzer to target analysis of a compound;

determining, utilizing a comparator to compare voltages associated with the periodic waveform to the reference voltage value, first voltages that are greater than the reference voltage value, second voltages that are less than the reference voltage value, and third voltages that are equal to the reference voltage value;

generating, utilizing the rectangular-waveform generator, a first rectangular waveform with:

first high values representing when the first voltages are greater than the reference voltage value; and first low values representing when the second voltages are less than the reference voltage value and the third voltages are equal to the reference voltage value;

generating, utilizing the rectangular-waveform generator, a second rectangular waveform with:

second high values representing when the second voltages are less than the reference voltage value and the third voltages are equal to the reference voltage value; and second low values representing when the first voltages are greater than the reference voltage value;

generating a mass filter based at least on the first rectangular waveform and the second rectangular waveform as applied to the mass analyzer, the first rectangular waveform and the second rectangular waveform defined based at least in part on a resolution of the DAC, a maximum amplitude of the periodic waveform, and a minimum change in voltage to alter output of the comparator, wherein a duty cycle resolution associated with the first rectangular waveform and the second rectangular waveform is down to at least $1.9\times10^{-5}$, the mass filter is configured to filter ions associated with compounds with a molecular weight of about 1 gram/mol to about $1\times10^{9}$ grams/mol; and receiving data from an ion detector indicating detection of the ions passing through the mass analyzer.

6. The method of claim 5, further comprising:

setting a number of steps through a phase accumulator of a numerically-controlled oscillator;

causing, via the numerically-controlled oscillator, oscillation of an electronic signal at a frequency;

converting one or more output values from the phase accumulator to one or more amplitudes;

generating, based at least in part on the DAC, a waveform from the one or more amplitudes; and generating the periodic waveform based at least in part on the waveform as filtered by a low-pass filter.

7. The method of claim 5, wherein the reference voltage value comprises a first reference voltage value, and further comprising:

causing the first reference voltage value to increase or decrease to a second reference voltage value; and applying the second reference voltage value to the rectangular-waveform generator such that the ions associated with a compound become trapped within the mass analyzer.

8. The method of claim 5, wherein the reference voltage value comprises a first reference voltage value, and further comprising:

causing the first reference voltage value to increase or decrease to a second reference voltage value;

applying the second reference voltage value to the rectangular-waveform generator such that at least a portion of the ions associated with the compound fracture into fractured ions; and detecting, via the ion detector, the fractured ions.

9. The method of claim 5, wherein the duty cycle resolution is set based at least in part on the equation:

$$DC=(\cos^{-1}V_c/V)$$

wherein DC is a duty cycle, $V_c$ is the reference voltage input set by the DAC, and V is the zero to peak voltage of the periodic waveform.

10. The method of claim 5, further comprising:

altering at least one of the first rectangular waveform or the second rectangular waveform while the ions associated with the compound travel through a centerline of the mass analyzer; and causing a stability of the ions to change based at least in part on altering the at least one of the first rectangular waveform or the second rectangular waveform.

11. The method of claim 5, wherein altering the at least one of the first rectangular waveform or the second rectangular waveform is performed at a rate of at least one of 5 microseconds or less than 5 microseconds.

12. The method of claim 5, wherein the periodic waveform comprises at least one of a triangular waveform or a sawtooth waveform.

13. A system, comprising:

one or more processors; and computer-readable media storing computer-executable instructions that, when executed by the one or more processors, cause the one or more processors to perform operations comprising:

setting, utilizing a digital-to-analog converter (DAC), a reference voltage value to be applied to a rectangular-waveform generator;

receiving a periodic waveform to compare with the reference voltage value, the periodic waveform configured to operate at frequencies for use by a mass analyzer to target analysis of a compound;

determining, utilizing a comparator to compare voltages associated with the periodic waveform to the reference voltage value, first voltages that are greater than the reference voltage value, second voltages that are less than the reference voltage value, and third voltages that are equal to the reference voltage value;

generating, utilizing the rectangular-waveform generator, a first rectangular waveform with:

first high values based at least in part on the first voltages being greater than the reference voltage value; and first low values based at least in part on the second voltages being less than the reference voltage value and the third voltages being equal to the reference voltage value;

generating, utilizing the rectangular-waveform generator, a second rectangular waveform with:

second high values based at least in part on the second voltages being less than the reference voltage value and the third voltages being equal to the reference voltage value; and second low values based at least in part on the first voltages being greater than the reference voltage value;

generating a mass filter based at least on the first rectangular waveform and the second rectangular waveform as applied to the mass analyzer, the first rectangular waveform and the second rectangular waveform defined based at least in part on a resolution of the DAC, a maximum amplitude of the periodic waveform, and a minimum change in voltage to alter output of the comparator, wherein a duty cycle resolution associated with the first rectangular waveform and the second rectangular waveform is down to at least $1.9\times10^{-5}$, the mass filter is configured to filter ions associated with compounds with a molecular weight of about 1 gram/mol to about $1\times10^{9}$ grams/mol; and receiving data from an ion detector indicating detection of the ions passing through the mass analyzer.

14. The system of claim 13, the operations further comprising:

setting a number of steps through a phase accumulator of a numerically-controlled oscillator;

causing, via the numerically-controlled oscillator, oscillation of an electronic signal at a frequency;

converting one or more output values from the phase accumulator to one or more amplitudes;

generating, based at least in part on the DAC, a waveform from the one or more amplitudes; and generating the periodic waveform based at least in part on the waveform as filtered by a low-pass filter.

15. The system of claim 13, wherein the reference voltage value comprises a first reference voltage value, and the operations further comprising:

causing the first reference voltage value to increase or decrease to a second reference voltage value; and applying the second reference voltage value to the rectangular-waveform generator such that the ions associated with the compound become trapped within the mass analyzer.

16. The system of claim 13, wherein the reference voltage value comprises a first reference voltage value, and the operations further comprising:

causing the first reference voltage value to increase or decrease to a second reference voltage value;

applying the second reference voltage value to the rectangular-waveform generator such that at least a portion of the ions associated with the compound fracture into fractured ions; and detecting, via the ion detector, the fractured ions.

17. The system of claim 13, wherein the duty cycle resolution is based at least in part on the equation:

$$DC=(\cos^{-1} V_c/V)$$

wherein DC is a duty cycle, $V_c$ is the reference voltage input set by the DAC, and V is the zero to peak voltage of the periodic waveform.

18. The system of claim 13, the operations further comprising:

altering at least one of the first rectangular waveform or the second rectangular waveform while the ions associated with the compound travel through a centerline of the mass analyzer; and causing a stability of the ions to change based at least in part on altering the at least one of the first rectangular waveform or the second rectangular waveform.

19. The system of claim 13, wherein altering the at least one of the first rectangular waveform or the second rectangular waveform is performed at a rate of at least one of 5 microseconds or less than 5 microseconds.

20. The system of claim 13, wherein the periodic waveform comprises at least one of a triangular waveform or a sawtooth waveform.

* * * * *